US006197076B1

(12) United States Patent
Braunschweig et al.

(10) Patent No.: US 6,197,076 B1
(45) Date of Patent: Mar. 6, 2001

(54) ABRASIVE ARTICLE METHOD OF MAKING SAME AND ABRADING APPARATUS

(75) Inventors: Ehrich J. Braunschweig, Woodbury; Donald R. Bell, Stillwater, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/286,569

(22) Filed: Apr. 5, 1999

(51) Int. Cl.[7] ..... B24D 3/00; B24D 3/28; B24D 11/02; B24D 17/00

(52) U.S. Cl. ..... 51/297; 51/298; 51/307; 51/309; 451/538

(58) Field of Search ..... 51/295, 297, 298, 51/307, 309; 451/538

(56) References Cited

U.S. PATENT DOCUMENTS

| | | | | |
|---|---|---|---|---|
| 3,147,528 | | 9/1964 | Erb . | |
| 4,437,269 | | 3/1984 | Shaw . | |
| 4,474,585 | | 10/1984 | Gruber . | |
| 4,609,581 | | 9/1986 | Ott . | |
| 5,260,015 | | 11/1993 | Kennedy et al. . | |
| 5,316,812 | * | 5/1994 | Stout et al. | 51/295 |
| 5,486,219 | | 1/1996 | Ford et al. . | |
| 5,518,795 | | 5/1996 | Kennedy et al. . | |
| 5,551,961 | | 9/1996 | Engen et al. . | |
| 5,573,619 | * | 11/1996 | Benedict et al. | 156/137 |
| 5,620,769 | | 4/1997 | Wessels et al. . | |
| 5,669,120 | | 9/1997 | Wessels et al. . | |
| 5,669,941 | * | 9/1997 | Peterson | 51/295 |
| 5,672,186 | | 9/1997 | Chesley et al. . | |
| 5,681,612 | * | 10/1997 | Benedict et al. | 51/295 |
| 5,702,797 | | 12/1997 | Sakakibara et al. . | |

FOREIGN PATENT DOCUMENTS

| | | |
|---|---|---|
| WO 93/12912 | 7/1993 | (WO) . |
| WO 95/19242 | 7/1995 | (WO) . |
| WO 98/12021 | 3/1998 | (WO) . |

* cited by examiner

*Primary Examiner*—Michael Marcheschi
(74) *Attorney, Agent, or Firm*—Paul W. Busse

(57) ABSTRACT

The invention provides a substantially flat coated abrasive article having a fabric-reinforced backing which may include engaging elements such as hooks for releasable attachment to the surface of an abrading apparatus and a method of making the article. The invention also provides an abrading apparatus which includes a back-up pad having releasably attached thereto the abrasive article. The article comprises a substantially flat sheet-like substrate comprised of thermoplastic material and a porous fibrous reinforcing element contained within the substrate and an abrasive layer disposed on a surface of the substrate. The opposite surface of the substrate may include the engaging elements. The article is made by deploying the fabric on a surface, depositing molten thermoplastic polymer over the fabric, removing the substrate from the surface and applying the abrasive layer to one surface of the substrate.

16 Claims, 3 Drawing Sheets

ABRASIVE ARTICLE METHOD OF MAKING SAME AND ABRADING APPARATUS

TECHNICAL FIELD

The invention relates to a coated abrasive article having a fabric-reinforced backing or substrate, such as an abrasive disc or an abrasive sheet, which may include engaging elements such as hooks for releasable attachment to the surface of an abrading apparatus and a method of making such an abrasive article. The present invention also relates to an abrading apparatus which includes a back-up pad having releasably attached thereto the abrasive article.

BACKGROUND OF THE INVENTION

Abrasive articles are used in any of a variety of fields for abrading material from a surface of a workpiece. For example, an abrasive disc may be releasably mounted on a back-up pad for rotative movement by a random orbital sander. When the disc is rotated, and the exposed abrasive surface of the disc is urged against the workpiece surface, material may be removed from the workpiece. This operation may be desirable for surface refinement purposes, or for the removal of excess material from the workpiece.

Abrasive discs are typically releasably attached to a back-up pad, which supports the abrasive disc during the abrading process. The back-up pad includes a generally planar major surface, to which the abrasive article, such as a disc or sheet, may be attached. Although back-up pads may be hand held, back-up pads are more commonly used in conjunction with powered abrading apparatuses, such as electric or pneumatic sanders.

Several types of abrasive discs have some type of attachment system incorporated into the disc to enable the disc to be releasably attached to a back-up pad, e.g., discs backed with pressure sensitive adhesive, textile materials, or engagement elements.

Textile backed discs typically include a textile loop material on the back surface of the abrasive article opposite the abrasive surface. The textile material can be, for example, woven or non-woven web, brushed nylon, brushed polyester, knitted fabrics, and stitch-bonded fabrics. Textile discs are described in U.S. Pat. No. 4,437,269 (Shaw) and U.S. Pat. No. 4,609,581 (Ott), and an example of a textile abrasive disc is available from the Minnesota Mining and Manufacturing Company of St. Paul, Minn. under the designation Hookit™ discs. Textile discs are typically used in conjunction with a back-up pad having a plurality of engaging members that are bonded to the attachment surface of the back-up pad. The engaging members on the back-up pad are designed to engage the textile material of the textile disc, to secure the abrasive disc to the back-up pad.

U.S. Pat. No. 4,437,269 (Shaw) relates primarily to textile discs of the type described above, but also briefly discusses a type of disc referred to herein as the "stalk" disc. Specifically, the '269 patent discloses a back-up pad and a disc, wherein one of the two components has a textile material on one face, and the other of the pad and the back of the disc has a layer thereon from which extend loop-engaging or curl-engaging members in the form of monofilament stalks having unhooked ends. The stalks are engaging elements which project from a backing, and slidingly intermesh with, but do not hook, a loop-like textile material on an opposed surface to attach the two surfaces together.

U.S. Pat. No. 5,672,186 describes an abrasive article for releasable affixation to a mating surface having engaging structures which includes a plurality of hooking stems affixed to and projecting from the engagement surface of the article. The hooking stems each include means for hooking the engaging structures of the mating surface to releasably affix the abrasive article to the mating surface. In one variation, the abrasive layer is bonded directly to the surface of the substrate opposite the engagement surface.

The abrasive articles of the '186 patent typically are made by depositing molten thermoplastic polymeric material onto a smooth surface which bears a plurality of cavities which form the engaging elements or their precursors to provide a flat sheet-like substrate. The substrate is then removed from the surface on which it is formed, any precursor engaging elements converted to engaging elements, and an abrasive coating is applied to the surface opposite that which bears the engaging elements. Such application typically involves coating this surface with a liquid curable binder composition, depositing abrasive particles on the coated surface so that they are at least partially embedded in the exposed surface of the coating, at least partially curing the coating by heating, applying a second coating of a second binder material over the exposed surface and deposited abrasive particles and then curing any uncured first binder coating and the second binder coating by further heating to provide the abrasive article.

Unfortunately, the thermoplastic polymeric material from which the substrate is formed typically increases in dimension on heating to a greater degree than that of the materials that are typically used as binder materials to make the abrasive coating. Such a differential in dimensional expansion typically causes the substrate to distort as a result of heat used to cure the binder material of the abrasive layer and may cause undesirable curling or other deformation in the resultant abrasive product.

It is, thus, desirable to provide an abrasive disc which overcomes the disadvantage of being distorted on formation due to the differential dimensional expansion on heating of the thermoplastic polymer and the binder material.

SUMMARY OF THE INVENTION

The present invention provides a substantially flat abrasive article with a substrate having an abrasive coating on one surface and an opposite surface. The substrate is able to maintain its substantially flat shape without distortion even though the abrasive coating is applied directly to and heat cured on the surface of the substrate. The abrasive article of the present invention comprises:

a. a substantially flat sheet-like substrate comprised of a thermoplastic polymeric material which increases in dimensions on heating, the substrate having a first major surface, an opposite second major surface, a thickness and a porous fibrous reinforcing element contained within the thickness of said substrate having fibers encapsulated by and adhered to the thermoplastic polymeric material and having the ability to decrease in surface dimensions on heating to substantially negate the increase in dimensions of the thermoplastic polymeric material on heating; and b. an abrasive layer disposed on the second major surface comprised of abrasive particles and cured binder material having a lesser dimensional change on heating than that of said thermoplastic polymeric material.

The present invention also provides a substantially flat abrasive article with a substrate having an abrasive coating on one surface and engaging elements on an opposite surface for releasable affixation to a mating surface. The substrate is able to maintain its substantially flat shape without distortion even though the abrasive coating is applied directly to and heat cured on the surface of the substrate. The abrasive article of the present invention comprises:

a. a substantially flat sheet-like substrate comprised of a thermoplastic polymeric material which increases in dimensions on heating, the substrate having a first major surface, an opposite second major surface, a thickness, a plurality of engaging elements provided on and projecting from the first major surface including means for engaging structures to releasably affix the abrasive article to a surface and a porous fibrous reinforcing element contained within the thickness of said substrate having fibers encapsulated by and adhered to the thermoplastic polymeric material and having the ability to decrease in surface dimensions on heating to substantially negate the increase in dimensions of the thermoplastic polymeric material on heating; and b. an abrasive layer disposed on the second major surface comprised of abrasive particles and cured binder material having a lesser dimensional change on heating than that of said thermoplastic polymeric material.

In a further embodiment, the invention also provides an abrading apparatus which comprises:

a. an abrasive article comprising substantially flat sheet-like substrate comprised of a thermoplastic polymeric material which increases in dimensions on heating, the substrate having a first major surface, an opposite second major surface, a thickness, a plurality of engaging elements provided on and projecting from the first major surface including means for engaging structures to releasably affix the abrasive article to a surface and a porous fibrous reinforcing element contained within the thickness of the substrate having fibers encapsulated by and adhered to the thermoplastic polymeric material and having the ability to decrease in surface dimensions on heating to substantially negate the increase in dimensions of the thermoplastic polymeric material on heating; and an abrasive layer disposed on the second major surface comprised of abrasive particles and cured binder material having a lesser dimensional change on heating than that of said thermoplastic polymeric material; and b. a back-up pad comprising a support member having a major surface which includes means for engaging the engaging elements of the abrasive article.

The invention further provides a method of making an abrasive article which comprises the steps of:

a. deploying a porous fabric having the ability to decrease in surface dimensions on heating and being comprised of fibers which are capable of being encapsulated by and adhered to molten thermoplastic polymer over a contact surface;

b. depositing the molten thermoplastic polymer over the fabric to encapsulate the fibers to provide on cooling a fabric-reinforced substrate having a first major surface, an opposite second major surface and a thickness;

c. removing the substrate from the contact surface; and d. applying to the second major surface an abrasive layer comprised of abrasive particles in a binder material.

The invention further provides a method of making an abrasive article which comprises the steps of.

a. deploying a porous fabric having the ability to decrease in surface dimensions on heating and being comprised of fibers which are capable of being encapsulated by and adhered to molten thermoplastic polymer over a smooth surface which includes a plurality cavities capable of forming erect engaging elements or their precursors;

b. depositing the molten thermoplastic polymer over the fabric to encapsulate the fibers and fill the cavities to provide on cooling a fabric-reinforced substrate having a first major surface bearing the engaging elements or their precursors, an opposite second major surface and a thickness;

c. removing the substrate from the smooth surface and converting any precursor engaging elements to engaging elements; and d. applying to the second major surface an abrasive layer comprised of abrasive particles in a binder material.

Step a and b may have any order relative to one another. That is, step b may be carried out before step a, simultaneous with step a or after step a.

A preferred method of applying the abrasive layer is by:

a. coating the second major surface with a liquid curable first binder material in a thickness sufficient to adhere abrasive particles deposited thereon;

b. depositing abrasive particles on the coating provided by step a to provide an exposed surface of the first binder material coating having at least partially embedded therein deposited abrasive particles;

c. at least partially curing the first binder material coating;

d. coating the deposited abrasive particles and exposed surface of the first binder material coating with a second binder material coating; and e. curing any uncured first binder material and the second binder material coating to provide the abrasive article.

In a further embodiment, the method comprises the step of converting the coated abrasive article into an appropriate shape such as that of a disc or a sheet. Other shapes are also contemplated and the selection of the particular shape would be within the ability of one skilled in the art.

With respect to the present invention, the following terms shall have the meanings set forth below:

"Engaging element" shall mean any of a variety of elements adapted to engage a fabric, fibrous substrate or other structure provided by a stem or stalk which is configured or capped to have a portion which penetrates and becomes temporarily engaged with the fabric, fibrous substrate or mating other structure.

"Engaging element precursor" shall mean a stem or stalk which may be modified to become an engaging element such as by having its distal end modified to be a hook or cap.

"Substantially flat" shall mean, with respect to the abrasive article, an undistorted flat configuration while the abrasive article is attached in an abrading apparatus and shall include a configuration having a "moderate degree of curl" (as later defined in the Examples) while the abrasive article is unattached to an abrading apparatus.

"Decrease in surface dimensions" shall mean, with respect to porous fibrous reinforcing element, a decrease in at least one surface dimension, e.g., length or width or both surface dimensions, e.g., length and width.

BRIEF DESCRIPTION OF THE DRAWINGS

The present invention will be further explained with reference to the appended figures, wherein like structure is referred to by like numerals throughout the several views and wherein.

DETAILED DESCRIPTION OF THE INVENTION

Figure 1:
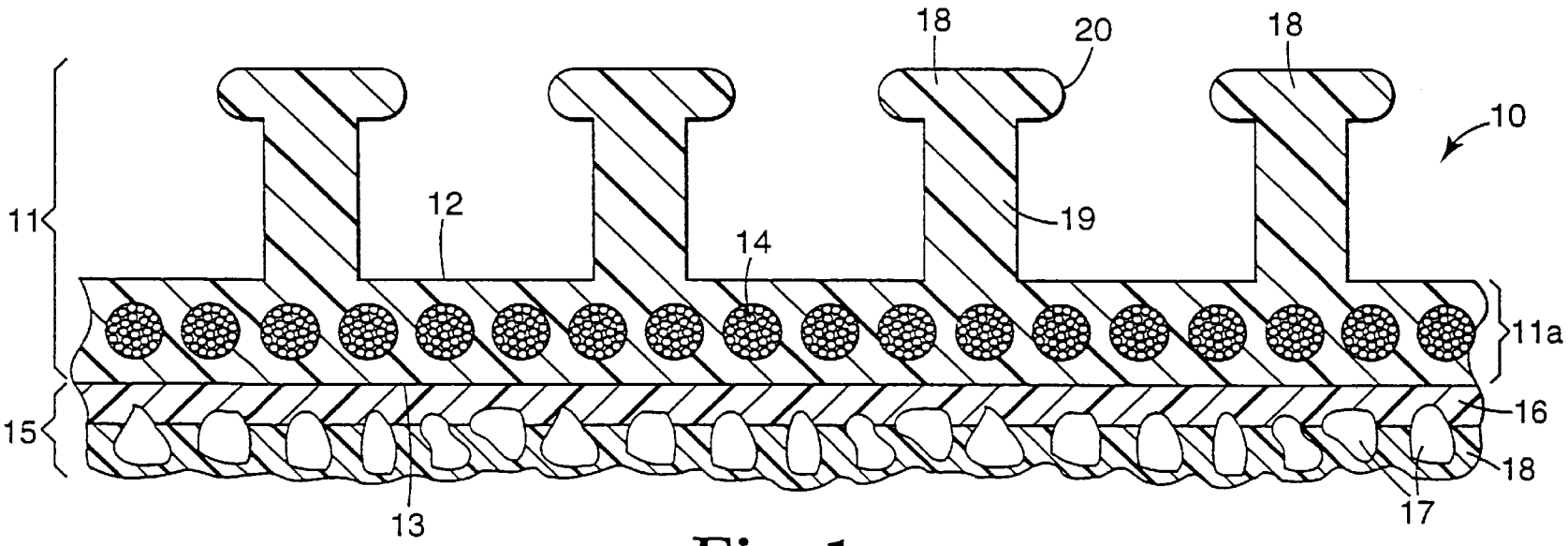
FIG. 1 is an enlarged sectional view of a segment of an abrasive article according to the present invention.

FIG. 1 shows an enlarged sectional view of an abrasive article 10 having a substrate 11 which includes a thickness 11*a* measured between a first major surface 12 and a second major surface 13 and engaging elements 18 projecting from first major surface 12. Engaging elements 18 include stalk 19 and engaging head or end 20. Substrate 11, including engaging elements 18, is formed from a thermoplastic material which typically expands in dimensions on heating. Substrate 11 also includes a reinforcing fabric having yarns 14 deployed between its first major surface 12 and second major surface 13 comprised of a fabric which will decrease in surface dimension on heating to negate the expansion of the thermoplastic material on heating.

The abrasive article includes abrasive layer 15 directly deployed on and adhered to second major surface 13 by the first binder material which provides make coat 16 having dispersed and partially embedded therein abrasive particles 17 which are further coated by a second binder material coating 18 typically referred to in the abrasive arts as a size coating.

While first and second major surfaces are respectively shown as being smooth and flat, such a condition is not necessary to the present invention and these surfaces may be other than smooth and flat and in some cases are undulated to conform to the configuration of the fabric formed of yarns 14. The fabric may be woven to provide yarns 14 or nonwoven and is made of a material and in a configuration which will decrease in dimensions, i.e., surface area, sufficiently to negate the increase in surface area, resulting from heating the thermoplastic material during the application of the adhesive layer 15 to surface 13 of substrate 11. Useful substrates include those where the fabric provides sufficient mass to provide a sufficient physical presence to negate the expansion of the thermoplastic material, that typically being at least about 30 percent by weight of the total weight of substrate 11, preferably at least 40 percent by weight, and most preferably at least 50 percent by weight.

The fabric may be a woven fabric, a nonwoven fabric, a stitch-bonded fabric, a scrim or the like. The yarns or fibers forming the fabric may be made from fiber materials selected from the group consisting of polyester, polyamide (including nylon), polyethylene, polypropylene, polyaramid, rayon, cotton and mixtures thereof. The fibers may be treated with conventional fiber/fabric treatments or they may be untreated prior to being incorporated into the substrate.

The preferred fabric is a polycotton woven fabric available from Milliken and Company under the trade designation style 924856 (28×32 weave) or style 924858 (34×36 weave). Useful fabrics will preferably have a tensile strength at break of in kg per cm, in both the machine and cross directions, of about 6 to 9, preferably 7 to 9, most preferably about 9, a basis weight in grams per $cm^2$ of about 0.005 to 0.03, preferably 0.01 to 0.02, most preferably 0.014 to 0.017, a thread count of threads per cm of 4 to 24, preferably 7 to 16, most preferably 11 to 14, a percent stretch at maximum stress of about 0 to 7%, preferably 0 to 6%, most preferably 0 to 5%, and a shrinkage at about 116° C. of about 0.8 to 1.2%, preferably 0.9 to 1.1%, most preferably about 1.0%.

The present invention addresses a problem in the formation of abrasive articles such as abrasive article 11 which is encountered because of the tendency of the thermoplastic material from which substrate 11 is formed to increase in dimensions on heating while the cured binder material for the make and/or size coat has a tendency to substantially maintain its dimensions on heating to the same temperature. Such a differential typically causes the abrasive article to distort in formation during the curing cycle of the make and size coat. This is avoided by the present invention by introducing a fabric into the substrate which has a tendency to decrease in dimensions on heating to the same temperature thereby negating the differential in dimensional change on heating of the other components of the abrasive article.

Abrasive particles 17 which are included in abrasive article 10 may be selected from any of a variety of abrasive materials that are commercially available in any of a variety of grade sizes. For example, the abrasive particles may be formed of garnet, emery, aluminum oxide, cubic boron nitride, silicon carbide, fused alumina-zirconia, diamond, ceramic aluminum oxide, and combinations thereof.

The abrasive particles may range in size from grade 36 to grade 500, or lower or higher, depending on the application, and may be modified or treated as is conventional in the abrasive art. Blends of different abrasive particles as well as grade sizes may also be utilized.

While abrasive layer 15 is shown as having a conventional make coat 16 and size coat 18, it is not necessary to have such an arrangement and abrasive layer 15 may be made by other conventional techniques for making coated abrasive articles. Such other conventional techniques include coating a coatable mixture including liquid curable binder material and the appropriate abrasive particles onto second major surface 13 of substrate 11 and curing the coating to provide the abrasive layer.

Surface 13 of substrate 11 preferably is primed before the abrasive coating is applied by conventional priming techniques. Preferably, the surface is primed by conventional corona treatment. Other priming techniques known in the abrasive art may also be employed.

Engaging elements 18 of abrasive article 10 may be any of a variety of known devices for this purpose. Such devices are well-known in the art as exemplified by U.S. Pat. Nos. 5,672,186 or 5,620,769, each of which is incorporated herein by reference.

The preferred engaging elements include a stalk 19 and an engaging end 20 which may be a hook, barb, or any other shape which may engage a fabric-type portion of a fabric-type part of a hook and loop fastening set. A preferred engaging end 20 is that depicted in FIG. 1 as being a disc-shaped flattened portion at the end of stalk 19. The particular dimensions of the fastener are known in the art, as exemplified by the disclosure of U.S. Pat. No. 5,672,186.

Engaging elements 18 are provided on first major surface 12 of substrate 11, as shown in FIG. 1. As used herein, engaging element means an element having a distal end that is spaced from the surface to which the element is attached, and structure that enables the engaging element to releasably hook engaging structures provided on an opposed surface. Engaging ends 20 may be selected from among numerous different designs, such as that shown and described herein. It should be understood that other engaging element designs are comprehended by the present invention, though they are not specifically described below.

Each engaging element 18 is provided on and projects from the first surface 12. The engaging element may be directly provided on the first surface 12 by being formed integrally with the first surface 12, or may be provided on an intermediate sheet or layer, which is affixed to the first surface. Stated differently, the stalks 19 may or may not be directly molded from the same material as the remainder of substrate 11. The engaging elements are preferably formed from the same material as the substrate, such that the engaging elements are unitary with the substrate.

Stalk 19 may have any suitable cross-sectional shape, taken parallel to first surface 12 of the substrate, including but not limited to a circle, an oval, a polygon (such as a star, a cross, a rectangle, or a parallelogram), or a multi-lobed shape (such as a daisy or a clover). The stalk 19 may be solid or hollow, as desired, and the cross-sectional area of the stalk taken parallel to the first surface 12 is preferably within the range of 0.002 to 25 square millimeters (0.000004 to 0.04 square inches), more preferably between 0.01 and 1.0 square millimeters (0.000016 to 0.0016 inches), and most preferably between 0.05 and 0.45 square millimeters (0.00008 and 0.0007 square inches). These size ranges are for engaging elements that are adapted for interengagement with a durable loop material.

The maximum diameter of the stalk, in the case of a cylindrical stalk, is preferably between approximately 0.05 and 5.0 mm (0.002 and 0.20 in), more preferably between approximately 0.13 and 1.0 mm (0.005 and 0.04 in), and most preferably between 0.25 and 0.76 mm (0.01 and 0.03 in). The overall length of the engaging element is preferably between approximately 0.01 and 10 mm (0.0004 and 0.40 in), more preferably between 0.05 and 2.6 mm (0.002 and 0.102 in), and most preferably between 0.13 and 1.0 mm (0.005 and 0.04 in). It should be noted that engaging element shapes, diameters, and lengths can be mixed within a given abrasive article, such that the abrasive article comprises engaging elements of more than one shape, diameter, and/or length. Also, the shape, size, and orientation of the engaging elements may be selected to provide a suitable shear strength and peel strength for a given application.

Engaging element stalks 19 may be straight or arcuate, are generally perpendicular to the first surface, although they may be inclined between about 30° and about 150° with respect to the first surface if desired, and may be arranged in a regular array or be randomly distributed across the first major surface 12. For example, it may be desirable to provide helical engaging element stalks, and to arrange the stalks in parallel, sinusoidal columns. The engaging element density can be selected as desired, and preferably is between approximately 8.0 and 310 engaging elements per square centimeter (50 and 2000 engaging elements per square inch), although other densities can be provided.

The engaging elements may also be arranged in a plurality of clusters. That is, two or more adjacent engaging elements may be placed close to each other in a cluster, with adjacent clusters separated from each other by a distance greater than the distance between the engaging elements within a cluster. The engaging elements within each cluster could be inclined at any suitable orientation, although the elements within each cluster are preferably inclined at different orientations. Furthermore, the clusters could be randomly or uniformly distributed over the surface to which the elements are attached, as suitable to the particular application. Clusters can be provided in a plurality of rows, or stripes, and those rows may be parallel (either straight rows, or curvalinear rows).

The engaging element and substrate material is a melt flowable, moldable thermoplastic material. Suitable thermoplastic materials include polyurethanes, polyamides, polyolefins (for example, polyethylene, polypropylene and compounded blends thereof which may include thermoplastic elastomeric materials such as ethylene-propylene elastomer), polyesters, and combinations thereof. The preferred material is a polypropylene/ethylene-proplyene elastomer blend which is available from Shell Oil Company under the trade designation SRD-7-560. These materials may also comprise one or more additives, including but not limited to fillers, fibers, anti-static agents, lubricants, wetting agents, surfactants, pigments, dyes, coupling agents, plasticizers, and suspending agents.

The engaging elements discussed above also include means for hooking an engaging structure on an opposed surface (such as a loop material) to releasably affix the abrasive article to the opposed surface. In one embodiment, the hooking means is shown as at least one head or engaging end 20 provided on each stalk 19, as shown in the side view illustrated in FIG. 1. A head, as used herein, means any structure that extends radially beyond the periphery of the stalk in at least one direction.

Head 20 may have any suitable three-dimensional shape, such as, for example, a hemisphere, a sphere, a cube, a mushroom cap, a cylinder, a cone, a pyramid, a disc. or a barb, to hook the engaging members of an opposed mating surface. It is also possible to provide a head having portions that extend toward the base of the stalk, creating an "underhang" portion of the head. In other embodiments, each stalk is provided with two or more heads, the shape of which may be selected as desired.

The length of head 20 is preferably between approximately 0.05 mm and 2.0 mm (0.002 and 0.079 in), and is more preferably between approximately 0.1 and 1.1 mm (0.004 and 0.045 in.), measured from the first point at which the head portion departs from the stalk to the point most distant therefrom. These size ranges are for engaging elements that are adapted for interengagement with a durable loop material.

The size of the portion of the head that extends radially beyond the stalk is selected to insure proper engagement and disengagement of the abrasive article and the opposed surface. If the head extends radially beyond the stalk for too little a distance, the disengagement force between the abrasive article and the opposed surface may be insufficient. Conversely, if the head extends beyond the stalk for too great a distance, the heads may not engage with the opposed surface, or if a sufficient number of heads engage, the disengagement force may be greater than is desired. Thus, it is preferred that the maximum head diameter exceed the stalk diameter by at least approximately 0.05 mm (0.002 in), but not by more than approximately 1.5 mm (0.06 in).

The engaging element heads are preferably generally perpendicular to the first surface, although they may be inclined with respect to the first surface if desired. Also, it may be desirable to provide heads at either a predetermined orientation or at a random orientation relative to each adjacent head, to increase the disengagement force associated with the disc. In addition, for an abrasive article such a disc to remain firmly attached to a mating surface while in use, it is preferred that if the heads on the stalks are provided on only one side of the stalk (known as a "directional" engaging element), then the heads on the stalks should not all have the same orientation.

Abrasive articles according to the present invention may be attached to surfaces, such as a back-up pad, having any suitable engaging structures, such as fibers, filaments (such as brushed nylon and brushed polyester), woven and non-woven fabrics, knitted fabric, and stitch-bonded fabrics. Other applications are also contemplated, such as attachment to foam (particularly open-cell form) or to a compatible set of engaging hooks.

The method of the present invention may be practiced in numerous ways, some of which are specifically described and illustrated herein to facilitate a complete understanding of the invention. It should be borne in mind with regard to each of the illustrated embodiments that although the projecting stalks 19 are shown as spaced apart, and comparatively tall relative to the thickness of the substrate, the stalks are typically on the order of 0.01 to 10.0 cm (0.0004 to 0.4 in) in length, and are typically provided at a density of approximately 8 to 310 stalks per square centimeter (50 to 2000 stems per square inch).

The engaging elements of the inventive method are preferably formed by a process requiring the addition of energy (in the form of heat or radiation, for example) to a formed thermoplastic or thermosetting resin. This process is believed to have utility in forming engaging elements having either heads or included hooked distal end angles of less than approximately 90 degrees, and stands in contrast to the textile manufacturing methods of the prior art.

Figure 2:
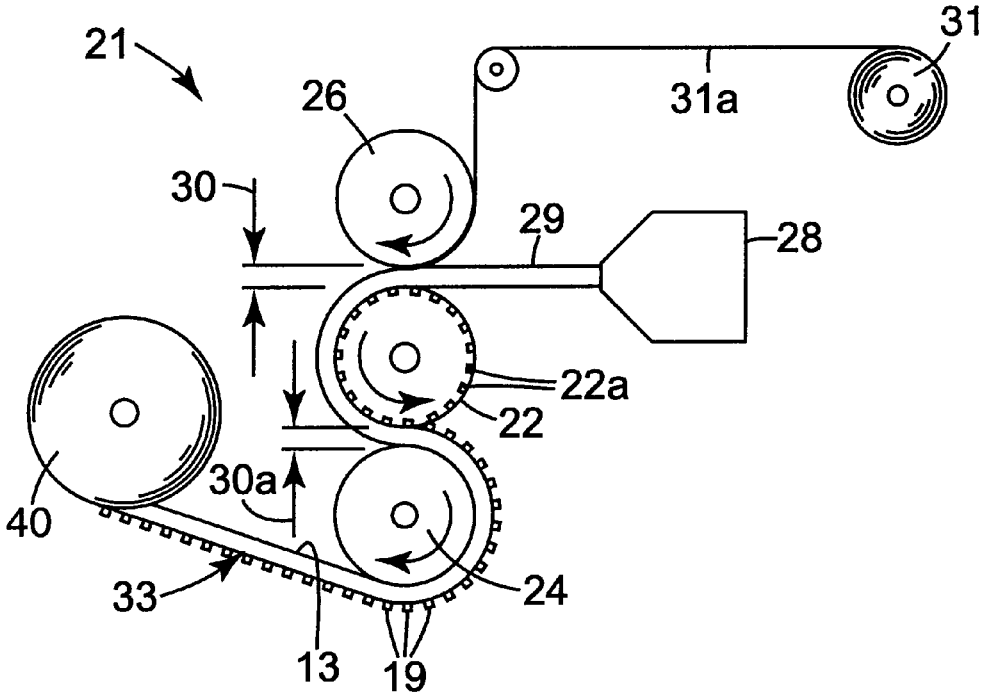
FIG. 2 is a schematic illustration of an apparatus and process for carrying out that part of the method of the present invention for making the reinforced substrate of the abrasive article of the invention.

FIG. 2 illustrates one embodiment of an apparatus and process for carrying out a part of the method of the present invention, i.e., the formation of substrate 11 shown in FIG. 1. As illustrated schematically in FIG. 2, apparatus 21 includes an extruder 28 adapted for extruding a melt flowable material, such as a thermoplastic resin, onto a mold in the form of roll 22 having a surface bearing a plurality of cavities 22*a,* which are adapted to form a like plurality of stalks from the flowable material. The cavities 22*a* may be arranged, sized, and shaped as required to form a suitable stalk structure from the melt flowable material. Simultaneous with extrusion of the melt flowable material, fabric 31*a* is unwound under tension from fabric roll 31 and fed with the extrudate 29 from extruder 28 for deployment onto the cavity-bearing surface of roll 22. Typically, a sufficient quantity of flowable material is extruded onto the cavity-bearing surface of roll 22 to form substrate precursor 33 which may be formed into substrate 11 by the apparatus shown in FIG. 3. Roll 22 is movable counter clockwise and is spaced from clockwise rotating roll 26 to provide a nip 30 and from opposed clockwise rotating roll 24 to provide nip 30*a*. The nip between opposed rolls 22 and 26 is adjusted to force the melt flowable material through the pores of the deployed fabric and into the cavities 22*a* of roll 22 to provide uniform substrate 33 which can be collected as roll 40. The temperature at which the foregoing process is carried out depends on the particular melt flowable material used. For example, the temperature is in the range of 230° to 290° C. (446° to 554° F.) for the preferred melt flowable thermoplastic material, a blend of about 72 weight percent polypropylene and about 28 weight percent ethylene-propylene copolymer elastomer, the blend being available from the Shell Oil Company of Houston, Tex., under the designation SRD-7587, and having a melt flow index in the range of about 26–34, preferably 30, grams per 10 minutes and a tensile strength at break of about 0.89 kg grams per cm (5 lb per inch). This polymer blend typically on heating to the process temperatures herein described expands in dimension by about one percent (1%) in surface area and a suitable fabric for use with this polymer blend will contract approximately 1% in surface area to negate the expansion of the polymer blend during heating. Other thermoplastic polymers and fabrics would be similarly selected to avoid distortion of the abrasive product.

The mold surface which provides the stem-bearing surface of substrate precursor 33 may be of a type used for either continuous processing (such as a tape, a cylindrical drum, as shown, or a belt), or batch processing (such as an injection mold), although the former is preferred.

U.S. Pat. No. 5,620,769, the disclosure of which is incorporated herein by reference, describes another suitable apparatus for making substrate 11, although there is no disclosure in this reference of selecting the thermoplastic material and fabric to avoid distortion in later process steps and no disclosure of using the formed article as a substrate for an abrasive product.

The cavities 22*a* of the mold in the apparatus depicted in FIG. 2 may be formed in any suitable manner, such as by drilling, machining, laser machining, water jet machining, casting, die punching, or diamond turning. The mold cavities should be designed to facilitate release of the stems therefrom, and thus may include angled side walls, or a release coating (such as a coating of polytetrafluoroethylene material mold release sold under the trade designation TEFLON™) on the cavity walls. The mold surface may also include a release coating thereon to facilitate release of the substrate from the mold.

The mold can be made from suitable materials that are rigid or flexible. The mold components can be made of metal, steel, ceramic, polymeric materials (including both thermosetting and thermoplastic polymers) or combinations thereof. The materials forming the mold should have sufficient integrity and durability to withstand the thermal energy associated with the particular molten thermoplastic material used to form the base sheet of the substrate and stalks. In addition, the material forming the mold preferably allows for the cavities to be formed by various methods, is inexpensive, has a long service life, consistently produces material of acceptable quality, and allows for variations in processing parameters.

Figure 3:
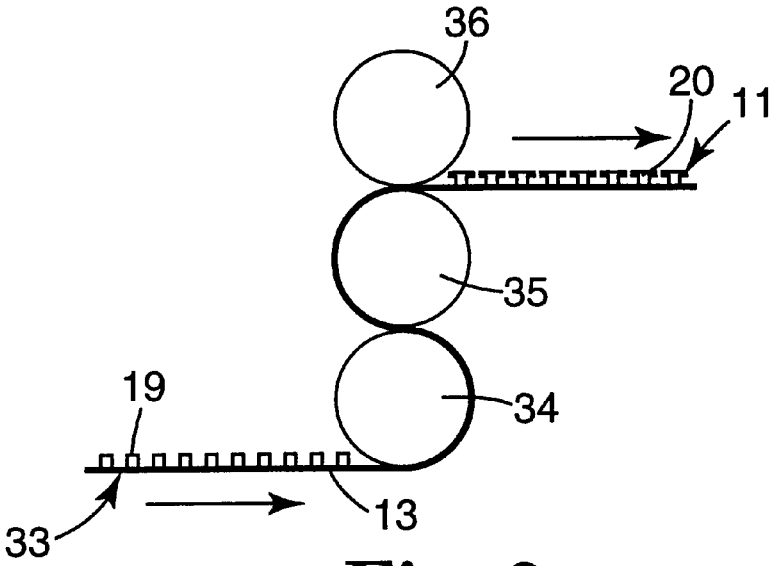
FIG. 3 is a schematic illustration of a second apparatus and process for converting engaging element precursors into engaging elements to provide a substrate comprising engaging elements for use in the abrasive article of the invention.

In the illustrated embodiment, the stalks projecting from substrate surface 12 are not provided with engaging means (e.g. heads on the distal ends of the stalks) at the time the substrate 33 leaves the molding surface of roll 22. Engaging means are provided in the illustrated embodiment, in the form of a head at the distal end of each stalk, by heating the stalks with a heated roll set 34, 35, 36, as depicted in FIG. 3, to thereby deform the distal end of the stalk, but may also be provided by contacting the distal ends of the stalks with a heated calendaring roller to form the heads 20. Other heating means are contemplated, including but not limited to convective heating by hot air, radiative heating by heat lamp or heated wire, and conductive heating by the heated roll or plate. Various other methods of deforming the stalks to provide heads 20 are well known in the art.

Once substrate precursor 33 is formed, as depicted in FIG. 2, and the engaging element precursors converted to engaging elements, as depicted in FIG. 3, the second surface 13 of substrate 11 may be primed, e.g., by corona treatment, in preparation for receiving an abrasive coating.

The preferred melt flowable material for use in the method of making substrate 11 are melt extrudable and will easily flow into openings under pressure without being too fluid and without degrading with heat at the required process temperatures. Such materials typically have a melt flow index, when tested according to ASTM test D1238 on the order of 10 to 50 grams per 10 minutes, preferably 20–40, grams per 10 minutes, most preferably 25–30 grams per 10 minutes.

The flowable thermoplastic material once incorporated into the abrasive product at room temperature has sufficient flexibility and strength for use under a broad spectrum of normal use conditions including temperatures which may vary from −20° C. to 100° C. Thermoplastic materials having a glass transition temperature ($T_g$) of at least about 0° C. and a tensile strength at break of at least about 0.9 kg per cm (about 5 lb per inch) have been found useful. Tensile strength is measured by drawing at a separation rate of 20 cm per minute, a 10.2 cm (4 inch) long 1.3 cm (0.5 inch) wide, 0.13 mm (5 mils) thick "dog bone" shaped test strip having an intermediate 1.3 cm (0.5 inch) narrow portion between the separating sample holding arms of tensile testing device commercially available under the trade designation INSTRON™ tensile tester and measuring the strength needed to break the sample, taken as the highest force observed during the test.

Figure 4:
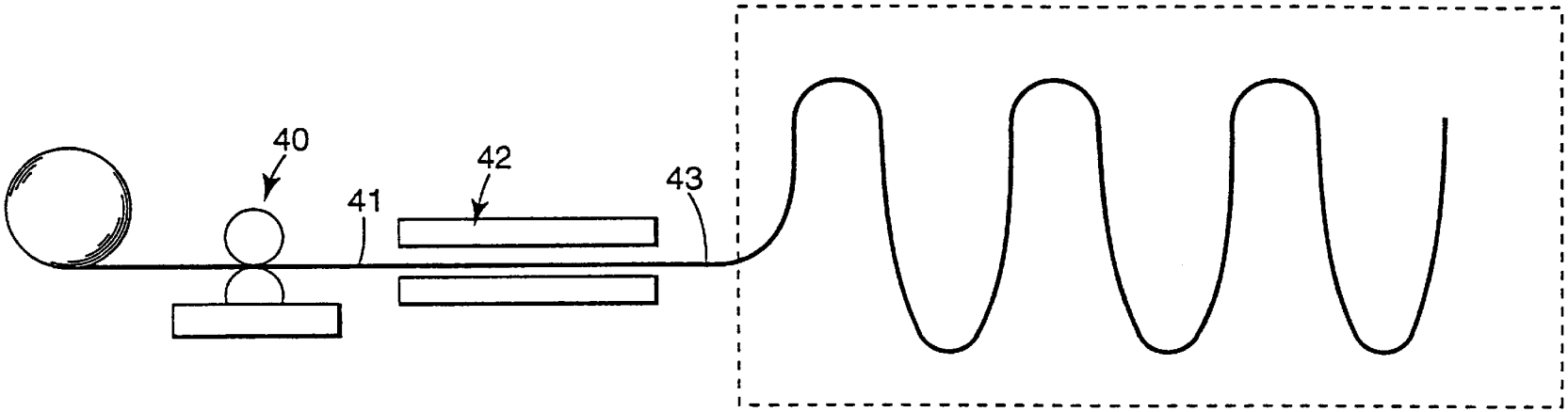
FIG. 4 is a schematic illustration of a third apparatus and process for applying a first binder material coating and abrasive grains to the substrate and for at least partially curing the first material coating.

As depicted in FIG. 4, abrasive coating may be applied by roll coating apparatus 40 which is utilized to apply a make coating of liquid curable binder material to the primed underside of substrate 33 which is then conducted through abrasive particle deposition station 41 where abrasive particles are projected onto the fresh make coating of resin binder and the abrasive coated substrate is conducted into a drying oven where the make coat of abrasive coated substrate is at least partially cured by either moving the coated substrate continuously through the oven or by merely hanging the coated web in the oven. The curing is usually conducted while the web is hung in the festooned arrangement that is shown in FIG. 4.

Figure 5:
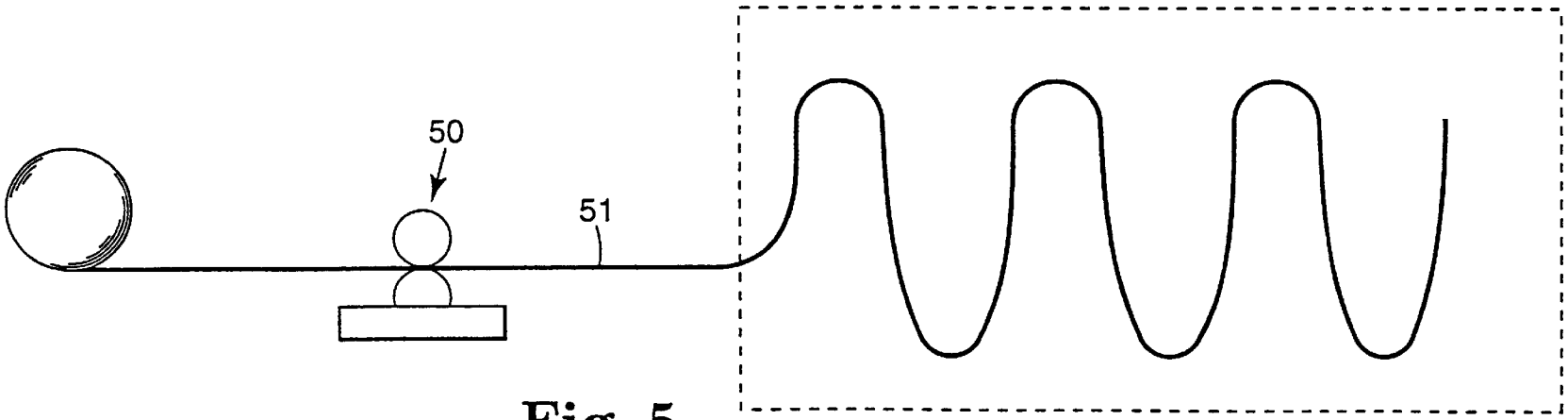
FIG. 5 is a schematic illustration of a fourth apparatus and process for applying a second resin coating to the coated article produced by the apparatus of FIG. 4 and curing the first and second binder material coatings to provide the abrasive article of the present invention.

As shown in FIG. 5, a size coating of liquid curable resin is applied by roll coating arrangement 50 to the first resin coating and deposited abrasive particles and the coated substrate 51 is conducted into a heated oven preferably in a festoon arrangement as shown in FIG. 5 to fully cure the first resin and second resin coatings to provide a coated abrasive product.

The make and size binder coatings are typically formed from an uncured or non-polymerized binder precursor. Upon exposure to the appropriate energy source, the binder precursor is polymerized or cured to form a binder material for the make or size coatings. The binder precursor comprises a curable material and optionally other additives. Examples of typical binder materials include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, polyester resins, fluorene modified epoxy resins and mixtures thereof.

Phenolic resins are widely used as the make and size coating materials in coated abrasive article binders because of their thermal properties, availability, cost and ease of handling. Such resins typically fall into one of two types of phenolic resins, resole and novolac. Resole phenolic resins typically have a weight ratio of formaldehyde to phenol of greater than or equal to one to one, more typically between 1.5:1.0 to 3.0:1.0. Novolac resins have a weight ratio of formaldehyde to phenol of less than to one to one.

Examples of useful urea formaldehyde binder resins are described in U.S. Pat. No. 5,486,219 (Ford, et al.), U.S. Pat. No. 5,551,961 (Engen, et al.) and U.S. Pat. No. 5,611,825 (Engen, et al.), each of which is incorporated herein by reference. The urea formaldehyde resin can be used by itself, or it may be blended with a phenolic resin to form the binder precursor.

The binder precursor may further comprise other optional additives, such as fillers (including grinding aids), fibers, antistatic agents, lubricants, wetting agents, surfactants, pigments, dyes, coupling agents, plasticizers and suspending agents. The amounts of these materials are selected to provide desired performance or processing properties. Examples of common fillers include calcium carbonate, silica, calcium meta silicate, cryolite, potassium tetrafluoroborate, feldspar and the like.

The coating, mineral deposition and curing steps shown in FIGS. 4 and 5 are well-known in the coated abrasive art and further detail on these steps is thought to be unnecessary since one skilled in the abrasive art would have sufficient knowledge to conduct these operations without further instructions.

After curing, the abrasive product may be flexed in a conventional manner to introduce cracks by utilizing conventional equipment. Flexing may be accomplished by any conventional means such as drawing the coated abrasive sheet under tension over an elongate edge. Once the coated abrasive product is flexed, it is conventionally converted into any of a variety of shapes such as that of a disc or a sheet adapted to fit into an abrasive apparatus which includes the mating part of the engaging means that is present on the first surface of the substrate. Such converting steps are well-known in the abrasive art and further details on converting is thought to be unnecessary.

EXAMPLES

The present invention will be further described with reference to the following examples, wherein all parts and percentages are by weight, unless otherwise indicated.

Preparation of Example 1

A substrate was formed using a process and apparatus such as illustrated in FIG. 2. The top and bottom rolls of a vertical stack of three temperature-controlled co-rotating 12.70-cm diameter (5-inch) cylindrical rolls on a vertical three roll casting station made by Killion Extruders, Inc. of Cedar Grove, N.J., were polished, chrome plated steel while the center roll was a patterned roll. The pattern was drilled into an aluminum sleeve 12.70 cm (5.0 inch) in diameter and having a wall thickness of 0.762 cm (0.300 inch) that was designed to fit a reduced diameter temperature controlled middle roll mandrel for the previously described Killion three roll vertical casting station. The holes were 0.0406 cm (0.016 inch) in diameter and 0.1778 cm (0.070 inch) deep with a cross web spacing of 0.1410 cm (0.0555 inch) and a machine direction spacing of 0.13759 cm (0.05417 inch). The cross web holes were offset 0.0706 cm (0.0278 inch) from each neighboring row of cross web holes. The top roll was temperature controlled to 150° C. (300° F.), the middle roll to 11° C. (52° F.) and the bottom roll to 150° C. (300° F.).

A 20.32 cm (8-inch) wide molten sheet of polypropylene (SRD7587 from Shell Oil Company of Houston, Tex.) was extruded at 238° C. (460° F.) from a dual manifold sheet die but only fed from a single manifold by a 3.81 cm (1½ inch) single-screw extruder (from Johnson Plastic Machinery, Chippewa Falls, Wis.), having an L/D of 29/1 and operating at 61 rpm. The Johnson extruder had a temperature profile ranging from 225° C. (400° F.) at the feed zone to 238° C. (460° F.) at the discharge zone, with adapter temperatures at 238° C. (460° F.). The Johnson extruder screw was of a general purpose single flight design. The die temperature was 238° C. (460° F.).

The molten sheet was introduced into the nip between the top and middle roll of the vertical stack of the three temperature-controlled co-rotating 5-inch diameter (12.70 cm) cylindrical rolls that were rotating at 2.74 meter (9 feet) per minute. The top and middle rolls were not gapped. A fabric scrim available from Milliken & Company, Spartanburg, S.C., style #924856 (32×28, ends x picks; 65/35 cotton polyester blended warp and fill) was also simultaneously introduced into the nip of the top and middle rolls of the vertical stack, the fabric contacting the top roll of the vertical stack for about a 90° wrap and hence rotated into the nip.

As the fabric scrim rotated into the nip, some of the molten polymer penetrated through the scrim and was solidified by the chilled roll surfaces, the top roll released the quenched substrate to follow the middle roll to the bottom roll. The quenched substrate thus had a molded pattern derived from the aforementioned pattern on the middle roll of the vertical stack, and was subsequently stripped away from the bottom roll. The substrate, thus produced, was about 0.254 mm (10 mil) thick, having a smooth back surface and an opposite surface which bore 0.75 mm (30 mils) stalks, each having a diameter on the order of 0.4 mm (17 mils).

As depicted in FIG. 3, the substrate was passed through a capping station provided by a set of three 25.4 cm (10 inch) diameter rolls 34, 35 and 36 stacked adjacent one another to provide nip gaps on the order of 0.5 mm (20–25 mils) between adjacent rolls with the outer rolls of the set being heated at 143° C. (290° F.) and the inner roll being cooled to 10° C. (50° F.) at a web speed of 76 meters per minute to create, at the end of each stalk, a 0.76 mm (30 mil) diameter cap having a thickness on the order of 0.1 mm (4 mils). The substrate so processed was wound on a take-up roll (not shown) for further processing, including corona priming of the surface on which the abrasive coating was to be applied.

In the next step, depicted in FIG. 4, the substrate having capped stalks was unwound from a supply roll and passed through a roll coating station 40 where a make coat resin was applied to the underside of the corona-primed substrate, i.e., the side opposite the side bearing the capped stalks. The make coat formulation consisted of 76% urea-formaldehyde resin, 12% phenolic resin, 4% ammonium chloride, 0.65% aluminum chloride and 16.35% water (hereafter Abrasive Binder Formulation I) to provide a dry coating weight of 0.12 gram per square cm. The coated web 41 was then conducted through a mineral coating facility 42 where grade P180 fused aluminum oxide was uniformly distributed into the make coating by using conventional techniques to provide mineral coated web 43, which had a mineral coating weight of 0.16 gram per square cm which was partially cured in a static festoon arrangement by heating for one hour at 90° C.

Thereafter, a size coating was applied to provide a dry coating weight of 0.12 gram per square cm, as depicted in FIG. 5, over the mineral-bearing make coat. The size coat consisted of 58% phenolic resin, 0.5% wetting agent, 23% calcium carbonate filler, 19% water and a trace of dye. The resultant coated product was then hung in a festoon arrangement and cured at 152° C. for 4 hours in an oven under static conditions.

In a second abrasive formulation, (hereafter called Abrasive Formulation II), the make coat consisted of 84.1% phenolic resin, 1.8% formaldehyde catalyst, and 14% water. The size coat was 70% phenolic resin, 14% calcium carbonate filler, 11.75% water, 3.5% $TiO_2$ and 0.03% dye. The coating and curing conditions for Abrasive Binder Formulation II were the same as those for Abrasive Binder Formulation I.

Preparation of Control Example A

The procedure was similar to the procedure for Example 1 except that no fabric scrim was used and subsequently described Abrasive Binder Formulation I was used instead of subsequently described Abrasive Binder Formulation II.

Preparation of Control Example B

The procedure was similar to the procedure for Example 1 except that no fabric scrim was used.

The tensile strength values for the above Substrate Materials are set forth in Table 1.

TABLE 1

| | Substrate Material Tensile Strength at Break | | | |
|---|---|---|---|---|
| | Tensile Strength (psi) | | Tensile Strength (MPa) | |
| Fabric | Machine Direction | Cross Web Direction | Machine Direction | Cross Web Direction |
| None | 1368 | 1260 | 9.4 | 8.7 |
| SRD7587 | 3188 | 2123 | 22.0 | 14.6 |

Curl Test Procedure

After application of the abrasive coating and complete curing, as described above, the amount of product deformation (typically curl) from a flat structure was measured by placing a test sample of each of the abrasive article of each Example, which had been converted to a 15.24 cm (6 inch) diameter disc, on a flat surface. The distance between the flat surface and the point on the abrasive article most distant from the flat surface was measured with a ruler. The "curl" scale shown in Table 2 was adopted.

TABLE 2

| Description | Distance |
|---|---|
| No Curl | 0–1.25 cm (0–0.5 inch) |
| Small Curl | 1.25–2.5 cm (0.5–1.0 inch) |
| Moderate Curl | 2.5–5.0 cm (1.0–2.0 inches) |
| Significant Curl | 5.0–10.1 cm (2.0–4.0 inches) |
| Very Curly | Curl so severe that it could not be measured |

Table 3 identifies the fabric used in each example, as well as the Abrasive Binder Formulation and curl test results.

TABLE 3

| Example Designation[1] | Fabric | Abrasive Binder Formulation | Degree of Curl of Abrasive |
|---|---|---|---|
| A | None | I | Very Curly |
| B | None | II | Very Curly |
| 1 | SRD7587 | II | Moderate Curl |

[1]Letter designations refer to comparative examples while number designations refer to examples of the invention.

Example 1 according to the invention and the control Examples were evaluated for effectiveness in attachment to an abrading tool and once mounted on such a tool for edge wear to verify the ability of the abrasive pad to remain attached under conventional use conditions. The tests were as follows:

Disc Attachment Test

Equipment

Air powered dual action hand held sander with loop-type attachment back up pad accessory.

15 cm (6 inch) round abrasive disc.

Metal workpiece 77 cm (30 inches) by 115 cm (45 inches) by 3.2 mm (⅛ inch).

Results from Test

Subjective ranking of attachment during conventional sanding.

Typical Reporting Nomenclature

Fly-off, Poor, Fair, Good, Outstanding.

Fly-off=Disc flies off during use.

Poor=Disc stays attached, but wrinkles over half the area of discs, or releases in half disc area.

Fair=Disc stays attached, some puckering or lifting of no more than 5 cm (2 inches) in any area.

Good=Disc stay attached well, no lifting or puckering of any area larger than 2.5 cm (1 inch).

Outstanding=Disc stay attached well with no pucker or lifting at any point on disc.

Desired Results

General acceptable test results are Good to Outstanding.

Test Procedure

Attach fresh abrasive disc to tool.

Sand with dual action sanding tool at various angles to workpiece in a random motion.

Apply approximately 9–13 kg (20–30 lb.) down pressure.

Stop and inspect, rank attachment.

Repeat.

Test results are shown in Table 4.

Disc Edge Wear Test

Equipment

Air powered dual action hand held sander with loop attachment back up pad accessory.

15.2 cm (6 inch) round abrasive disc.

Metal workpiece with 1.3 cm (0.5 inch) or higher edging.

Results from Test

Subjective ranking of abrasive edge wear after severe sanding into tight corners.

Edge wear includes determination as to whether the abrasive coat remained adhered to its backing; whether the backing remained in a uniform piece or broke apart or ripped; or the abrasive article tore during the test.

Typical Reporting Nomenclature

Very Poor, Poor, Fair, Good, Very Good, Outstanding.

Desired Results

General acceptable test results are Good to Outstanding.

Test Procedure

Attach fresh abrasive disc back up pad of tool.

Sand with sanding tool at a 0–5 degree angle to workpiece.

Apply approximately 9–13 kg (20–30 lb.) down pressure.

Sand into tight corners to wear abrasive.

Stop and inspect, rank attachment.

Repeat.

Attach fresh abrasive disc and repeat test for a total of 3 times per lot.

Test results are shown in Table 4.

TABLE 4

| Example Designation[1] | Disc Attachment | Disc Edge Wear |
|---|---|---|
| A | Outstanding | Outstanding |
| B | Outstanding | Outstanding |
| 1 | Outstanding | Outstanding |

[1]Letter designations refer to comparative examples while the number designation refers to the example of the invention.

The utility of the example according to the invention was established by two abrading tests as follows:

Hand-Held Machine Abrading Test

Equipment

Air powered dual action hand held sander with loop fastener back up pad accessory.

15 cm (6 inch) round abrasive disc.

Wood test samples.

Results from Test

Amount of test sample removed during sanding.

Typical Reporting Nomenclature

Cut in grams. Usually cut is an average of 3 to 5 samples of the same lot tested.

Test Procedure

Clean test sample with high pressure air.

Weigh sample.

Attach fresh abrasive disc to tool.

Sand with sanding tool at a 0–5 degree angle to test sample.

Apply approximately 6 kg (14 lb.) down pressure.

Sand for 2.0 minutes.

Clean sanded test sample with high pressure air.

Weigh sanded test sample.

Repeat three times, each time with fresh disc.

Results are reported as cut in grams in Table 5.

Fixed Abrading Test

Equipment

Abrasive tester commercially available under the trade designation Frazier Schiefer abrasion tester from Frazier Precision Instrument Company Inc. of Hagerstown, Md., with loop fastener back up pad accessory.

10 cm (4 inch) round abrasive disc.

Wood samples, 10 cm (4 inch) round by 1.3 cm (½ inch) thick.

Results from Test

Amount of wood test sample removed during sanding.

Typical Reporting Nomenclature

Cut in grams. Usually cut is an average of 3 to 5 samples of the same lot tested.

Test Procedure

Set machine for a 4.5 kg (10 lb) down force.

Clean test sample with high pressure air.

Weigh test sample.

Attach fresh abrasive disc to tool.

Turn machine on for 500 cycles. 1 cycle is 1 full rotation of the disc against the test sample which was held in fixed position.

Clean test sample after abrading with high pressure air.

Weigh abraded test sample.

Repeat three times, each time with fresh disc.

Test results in grams cut are reported in Table 5.

TABLE 5

| Abrading Testing Results | | | | |
|---|---|---|---|---|
| Example | Mineral | 500 Cycles Fixed Sanding By Machine[2] | | |
| Designation[1] | Adhesion | CAB[3] | Pine | Maple |
| B | Outstanding | 0.636 | 1.783 | 1.317 |
| 1 | Outstanding | 0.717 | 1.613 | 0.962 |

[1]The letter designation refers to a comparative example while the number designation refers to an example of the invention.
[2]Grams removed.
[3]CAB refers to a cellulose acetate butyrate workpiece having a 10 cm (4 inch) outer diameter and a 1 cm (0.5 inch) thickness available under the trade designation Polycast ™ from Seelye Plastics, Inc.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. An abrasive article for releasable affixation to a surface, said article comprising:

a. a substantially flat substrate sheet comprised of a thermoplastic polymeric material which increases in dimensions on heating, said substrate having a first major surface, an opposite second major surface, a thickness, a plurality of engaging elements provided on and projecting from said first major surface including means for engaging structures to releasably affix the abrasive article to a surface and a porous fibrous reinforcing element contained within the thickness of said substrate having fibers encapsulated by and adhered to said thermoplastic polymeric material and decreasing in surface dimensions on heating to substantially negate the increase in dimensions of said thermoplastic polymeric material on heating; and b. an abrasive layer disposed on said second major surface comprised of abrasive particles and cured binder material having a lesser dimensional change on heating than that of said thermoplastic polymeric material.

2. The abrasive article of claim 1 wherein said thermoplastic material is a blend of polypropylene and ethylene-propylene elastomer and said porous fibrous reinforcing element is a polycotton woven fabric.

3. The abrasive article of claim 1 wherein said porous fibrous reinforcing element has a weight of about 0.001 to 0.03 grams per $cm^2$.

4. The abrasive article of claim 1 wherein said porous reinforcing element comprises yarns having a thread count per cm of about 10 to 60.

5. The abrasive article of claim 1 wherein said porous reinforcing element has a percent stretch at maximum stress of about 0 to 7%.

6. The abrasive article of claim 1 wherein said porous reinforcing element has a tensile strength at break of about 6 to 9 kg per cm.

7. The abrasive article of claim 1 wherein said porous reinforcing element has a shrinkage at about 116° C. of about 0.8 to 1.2%.

8. The abrasive article of claim 1 wherein said binder material is a phenolic resin.

9. Method of making an abrasive article, said method comprising the steps of:

a. deploying a porous fabric which decreases in surface dimensions on heating and being comprised of fibers which are encapsulated by molten and adhered to thermoplastic polymer over a smooth surface which includes a plurality of cavities and forming erect engaging elements or their precursors;

b. depositing said molten thermoplastic polymer over the fabric to encapsulate said fibers and fill said cavities to provide on cooling a fabric-reinforced substrate having a first major surface bearing said engaging elements or their precursors, an opposite second major surface and a thickness;

c. removing said substrate from said smooth surface and converting any precursor engaging elements to engaging elements; and d. applying to said second major surface an abrasive layer comprised of abrasive particles in a binder material.

10. The method of claim 9 wherein said abrasive layer is applied to said second surface by the following steps:

a. coating said second major surface with a liquid curable first resin in a thickness sufficient to adhere abrasive particles deposited thereon;

b. depositing abrasive particles on the coating provided by step a to provide an exposed surface of said first binder material coating having at least partially embedded therein deposited abrasive particles;

c. at least partially curing said first binder material coating;

d. coating said deposited abrasive particles and exposed surface of said first binder material coating with a second binder material coating; and e. curing any uncured first binder material and said second binder material coating to provide said abrasive article.

11. The method of claim 9 further comprising the step of converting said coated abrasive article into a disc.

12. An abrasive article comprising:

a. a substantially flat substrate sheet comprised of a thermoplastic polymeric material which increases in dimensions on heating, the substrate having a first major surface, an opposite second major surface, a thickness and a porous fibrous reinforcing element contained within the thickness of said substrate having fibers encapsulated by and adhered to the thermoplastic polymeric material and decreasing in surface dimensions on heating to substantially negate the increase in dimensions of the thermoplastic polymeric material on heating; and b. an abrasive layer disposed on the second major surface comprised of abrasive particles and cured binder material having a lesser dimensional change on heating than that of said thermoplastic polymeric material.

13. The abrasive article of claim 12 wherein said thermoplastic material is a blend of polypropylene and ethylene-propylene elastomer and said porous fibrous reinforcing element is a polycotton woven fabric.

14. The abrasive article of claim 12 wherein said binder material is a phenolic resin.

15. A method of making an abrasive article, said method comprising the steps of:

a. deploying a porous fabric which decreases in surface dimensions on heating and being comprised of fibers which are encapsulated by and adhered to molten thermoplastic polymer over a contact surface;

b. depositing the molten thermoplastic polymer over the fabric to encapsulate the fibers to provide on cooling a fabric-reinforced substrate having a first major surface, an opposite second major surface and a thickness;

c. removing the substrate from the contact surface; and d. applying to the second major surface an abrasive layer comprised of abrasive particles in a binder material.

16. The method of claim 15 wherein said abrasive layer is applied to said second surface by the following steps:

a. coating said second major surface with a liquid curable first resin in a thickness sufficient to adhere abrasive particles deposited thereon;

b. depositing abrasive particles on the coating provided by step a to provide an exposed surface of said first binder material coating having at least partially embedded therein deposited abrasive particles;

c. at least partially curing said first binder material coating;

d. coating said deposited abrasive particles and exposed surface of said first binder material coating with a second binder material coating; and e. curing any uncured first binder material and said second binder material coating to provide said abrasive article.

* * * * *

UNITED STATES PATENT AND TRADEMARK OFFICE

CERTIFICATE OF CORRECTION

PATENT NO. : 6,197,076 B1
DATED : March 6, 2001
INVENTOR(S) : Ehrich J. Braunschweig et al.

It is certified that error appears in the above-identified patent and that said Letters Patent is hereby corrected as shown below:

Column 4,
Line 3, after "plurality" insert -- of --.

Signed and Sealed this

Ninth Day of April, 2002

*Attest:*

*Attesting Officer*

JAMES E. ROGAN
*Director of the United States Patent and Trademark Office*